US009108077B2

(12) United States Patent
Bass et al.

(10) Patent No.: US 9,108,077 B2
(45) Date of Patent: Aug. 18, 2015

(54) REVERSE RESISTANCE UNIT MOUNT FOR A BICYCLE TRAINER

(71) Applicant: Saris Cycling Group, Inc., Madison, WI (US)

(72) Inventors: Benjamin R. Bass, Madison, WI (US); Mark A. Dahl, Rice Lake, WI (US)

(73) Assignee: Saris Cycling Group, Inc., Madison, WI (US)

( * ) Notice: Subject to any disclaimer, the term of this patent is extended or adjusted under 35 U.S.C. 154(b) by 149 days.

(21) Appl. No.: 14/043,010

(22) Filed: Oct. 1, 2013

(65) Prior Publication Data

US 2014/0094349 A1 Apr. 3, 2014

Related U.S. Application Data

(60) Provisional application No. 61/708,311, filed on Oct. 1, 2012.

(51) Int. Cl.

| | |
|---|---|
| ***A63B 69/16*** | (2006.01) |
| ***A63B 21/015*** | (2006.01) |
| ***A63B 21/00*** | (2006.01) |
| ***A63B 22/06*** | (2006.01) |
| *A63B 21/012* | (2006.01) |
| *A63B 21/005* | (2006.01) |
| *A63B 21/008* | (2006.01) |

(52) U.S. Cl.

CPC ..... *A63B 21/015* (2013.01); *A63B 21/00069* (2013.01); *A63B 21/00076* (2013.01); *A63B 22/0605* (2013.01); *A63B 69/16* (2013.01); *A63B 21/005* (2013.01); *A63B 21/008* (2013.01); *A63B 21/0125* (2013.01); *A63B 2069/165* (2013.01)

(58) Field of Classification Search

CPC ..... A63B 21/00069; A63B 21/00076; A63B 21/012; A63B 21/0125; A63B 21/015; A63B 21/018; A63B 22/0605; A63B 69/16; A63B 2069/161–2069/168

See application file for complete search history.

(56) References Cited

U.S. PATENT DOCUMENTS

| | | | | |
|---|---|---|---|---|
| 3,724,844 | A | 4/1973 | Olmstead et al. | |
| 4,505,473 | A | 3/1985 | Pro | |
| 4,674,742 | A | 6/1987 | Baatz | |
| 4,941,651 | A | 7/1990 | Phillips | |
| 4,969,642 | A | 11/1990 | Phillips | |
| 5,152,729 | A | 10/1992 | Phillips | |
| 5,397,285 | A | 3/1995 | Haan et al. | |
| 5,433,681 | A * | 7/1995 | Minoura | 482/61 |
| 5,472,392 | A | 12/1995 | Haan et al. | |

(Continued)

FOREIGN PATENT DOCUMENTS

| | | |
|---|---|---|
| FR | 46952 | 11/1936 |
| WO | 2006102529 | 9/2006 |

*Primary Examiner* — Oren Ginsberg
(74) *Attorney, Agent, or Firm* — Boyle Fredrickson, S.C.

(57) ABSTRACT

A bicycle trainer includes a reverse resistance unit mounting arrangement that is configured to increase traction between a bicycle wheel and a resistance unit upon an increase in the speed of rotation of the wheel. The reverse resistance unit mounting arrangement is configured to mount the resistance unit in a suspension-type manner and has an actuator that initially positions the resistance unit against the bicycle wheel. The reverse resistance unit mounting arrangement tends to pivot the resistance unit against the bicycle wheel during use, to automatically bias the wheel toward the resistance unit to prevent slippage between the bicycle tire and the roller of the resistance unit.

15 Claims, 4 Drawing Sheets

(56) References Cited

U.S. PATENT DOCUMENTS

| | | | |
|---|---|---|---|
| 5,728,029 | A | 3/1998 | Minoura |
| 5,944,637 | A | 8/1999 | Stickler et al. |
| 6,162,152 | A | 12/2000 | Kuo |
| 6,488,611 | B1 | 12/2002 | Ambrosina et al. |
| 6,527,681 | B2 | 3/2003 | Tacx |
| 6,620,081 | B2 | 9/2003 | Phillips |
| 6,702,721 | B2 | 3/2004 | Schroeder |
| 6,843,758 | B2 | 1/2005 | Qiu |
| 6,964,633 | B2 | 11/2005 | Kolda et al. |
| 7,011,607 | B2 | 3/2006 | Kolda et al. |
| 7,470,220 | B2 | 12/2008 | Hernandez |
| 7,727,124 | B1 | 6/2010 | Lassanske et al. |
| 2005/0075220 | A1 | 4/2005 | Schroeder |
| 2009/0075785 | A1 | 3/2009 | Schroeder |

* cited by examiner

REVERSE RESISTANCE UNIT MOUNT FOR A BICYCLE TRAINER

CROSS-REFERENCE TO RELATED APPLICATIONS

This application claims priority under 35 U.S.C. §119 based on U.S. Provisional Patent Application No. 61/708,311, which was filed on Oct. 1, 2012, the subject matter of which is incorporated by reference in its entirety.

BACKGROUND OF THE INVENTION

1. Field of the Invention

The present invention relates in general to the field of stationary bicycles trainers. More particularly, the present invention relates to a mounting arrangement for a the resistance unit of a bicycle trainer, in which the bicycle is held stationarily in place. The resistance unit is located such that, when in use, traction is increased as the user applies more torque on the bicycle pedals.

2. Discussion of the Related Art

There are several types of bicycle training systems that provide resistance and/or hold a bicycle in a stationary position. For instance, many stationary bicycle trainers have resistance devices located in front of the rear tire. Others feature resistance devices located behind the rear tire. One issue with many bicycle training devices is that a decrease in traction occurs as the user applies more torque on the bicycle pedals, thus increasing the rotational speed of the rear wheel. Such a reduction in traction is undesirable in that it adversely effects intended operation of the bicycle trainer and may result in slippage of the bicycle tire relative to the resistance unit.

What is needed, therefore, is a bicycle trainer device that allows for a bicycle to be engaged with a resistance unit in a manner that prevents slippage and replicates real world friction and inertia, such that a user can experience conditions more closely simulating an outdoor ride.

BRIEF DESCRIPTION OF THE INVENTION

By way of summary, the present invention is a bicycle trainer system featuring a mounting frame and a resistance unit, wherein the resistance unit is located behind the rear wheel of the mounted bicycle.

In accordance with a first aspect of the invention, the bicycle trainer includes a wheel support system with an adjustment and locking, device such that a driven wheel of the bicycle can be suspended. Different sized tires and bicycles can be accommodated by such a system. Once the bicycle is mounted, a user can exert a pedaling force identical to the pedaling force on the bicycle while outdoors or on a track. The bicycle trainer frame may be of the type that has four feet that remain in contact with the ground while in use.

The mounting frame includes a reverse-mounted resistance unit, which applies resistance to rotation of the bicycle wheel. The reverse resistance unit is pivotably connected to the frame of the bicycle trainer such that, in use, the reverse resistance unit moves in a tightening direction against the wheel of the bicycle.

An adjuster is included on the reverse resistance unit to increase or decrease the tightness of the reverse resistance unit by rotating a knob. The reverse resistance unit is located such that, when in use, traction and inertia are increased as the user applies more torque on the bicycle pedals to increase wheel speed. This ensures that the wheel of the bicycle does not slip and therefore provides a more realistic feel and experience during use.

These and other features and aspects of the present invention will be better appreciated and understood when considered in conjunction with the following description and the accompanying drawings It should be understood, however, that the following description, while indicating a representative embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
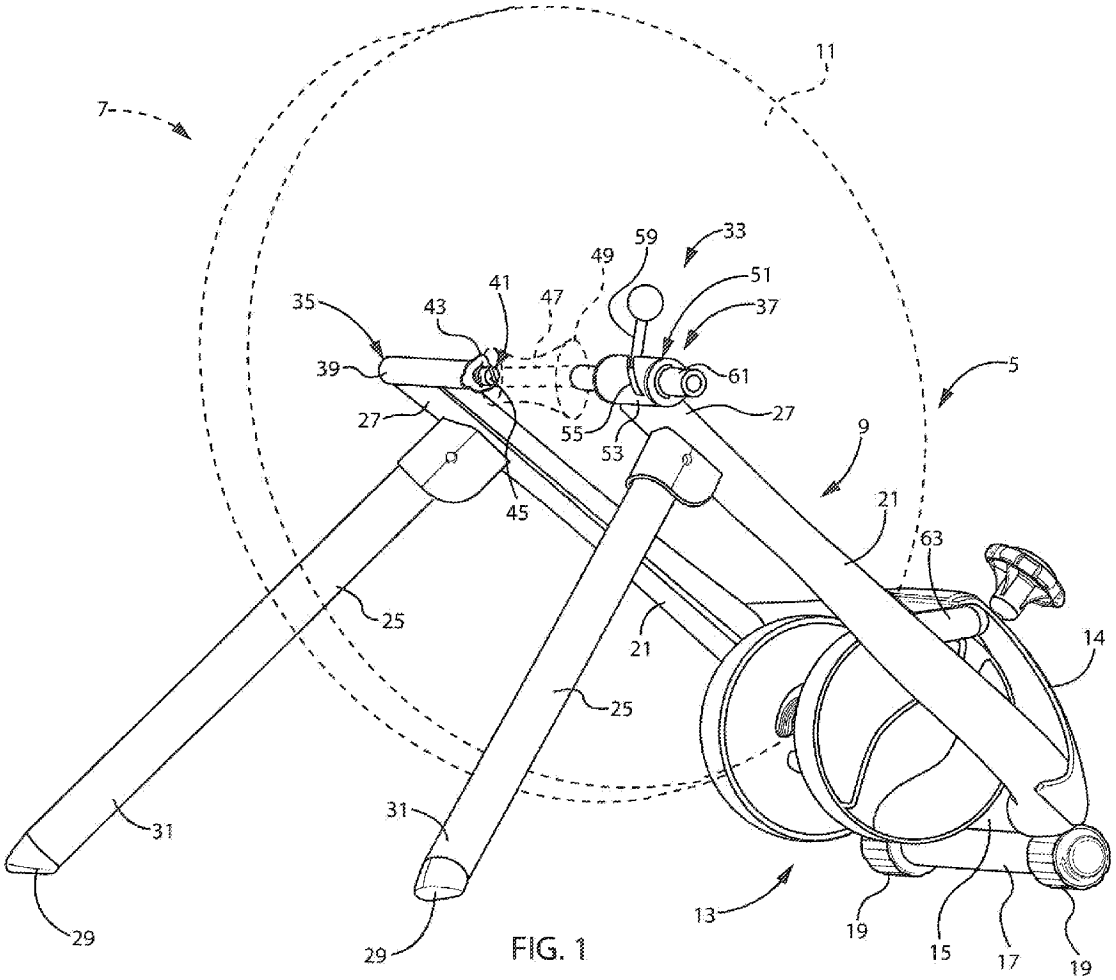
FIG. 1 is a rear side perspective view of one embodiment of a bicycle trainer incorporating the a reverse resistance unit mounting arrangement in accordance with the present invention.

In describing the embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected, attached, or terms similar thereto are often used. They are not limited to direct connection but include connection through other elements where such connection is recognized as being equivalent by those skilled in the art.

DETAILED DESCRIPTION OF THE INVENTION

Specific embodiments of the present invention will be described by the following non-limiting examples which will serve to illustrate various features of the invention. With reference to the drawing figures in which like reference numerals designate like parts throughout the disclosure, a representative embodiment of the present invention is a bicycle trainer 5 that allows for stationary training on a bicycle which may be a road or mountain bike or the like. The bicycle trainer 5 includes a frame 9 that supports the bicycle in a generally stationary position while a user exerts a pedaling effort to rotate a driven wheel 11 of the bicycle during a training session, in a manner as is generally known, in which the rotation of the driven wheel 11 is resisted by a resistance unit 13 that is arranged under a cover 14 and on the frame 9, as is described in greater detail elsewhere herein. The resistance unit 13 operates in a known way and can be one of an electronic, magnetic, fluid, or airflow-type resistance units such as, for example, those incorporated into various ones of the POWERBEAM PRO, SUPERMAGNETO PRO, JET-FLUID PRO, FLUID2, MAGNETO, and WIND series trainers available from CycleOps POWER of Madison. Wis.

Figure 2:
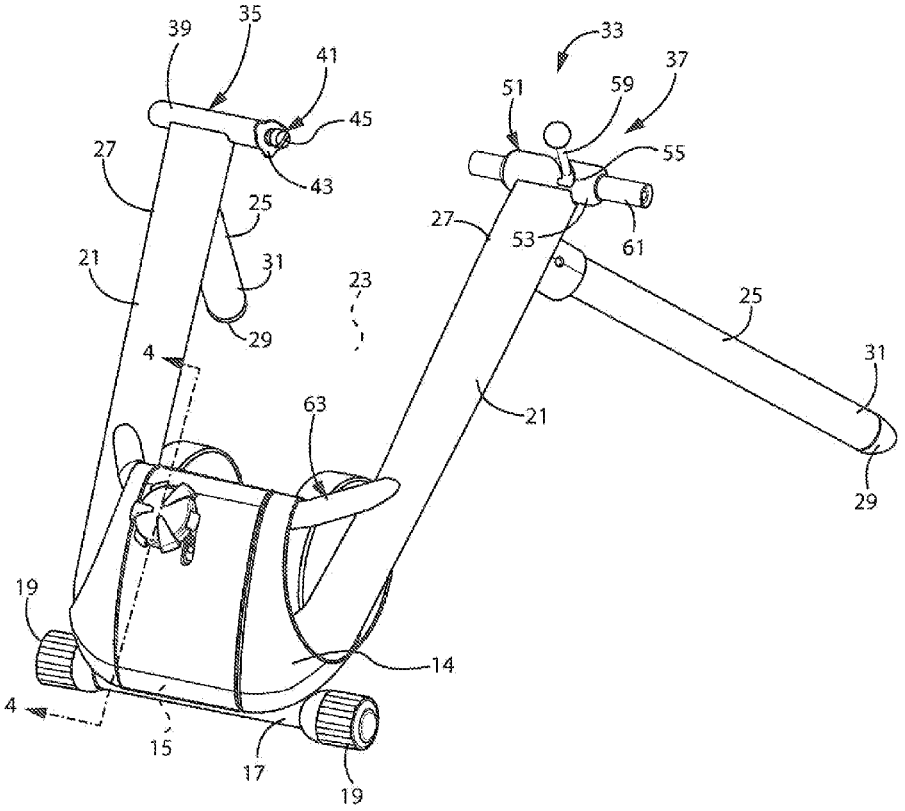
FIG. 2 is a front side perspective view of the bicycle trainer with reverse resistance unit mounting arrangement as shown in FIG. 1.

Referring to FIGS. 1 and 2, frame 9 is generally U-shaped and includes a lower segment 15 that is connected to a bar 17 that has a pair of rear feet 19 that engage the ground or other underlying support surface. A pair of side segments 21 extends from opposing ends of the lower segment 15 of the frame 9. The side segments 21 extend angularly from the lower segment 15 and bar 17. A space 23 is defined between the side segments 21 and in which the driven wheel 11 is arranged during use. Legs 25 extend downwardly from upper ends 27 of the frame side segments 21. Forward feet 29 are arranged at the lower ends 31 of the legs 25 and engage the ground or other underlying support surface. It is understood, however, that the frame of bicycle trainer 5 may have any other satisfactory configuration that supports the bicycle and the resistance unit 13.

Still referring to FIGS. 1 and 2, a wheel support system 33 is arranged toward an upper portion of the frame 9 for mounting the driven wheel 11 to the bicycle trainer 5. Wheel support system 33 includes an adjustment device 35 and a locking device 37 that are arranged at the upper ends 27 of the frame side segments 21. Adjustment device 35 includes a tube 39 that extends in a transverse direction with respect to the bicycle trainer 5. The tube 39 has internal threads (not shown) and an adjustment screw 41 which threads into the threads of the tube 39 and a threaded lock ring 43 that is threaded and concentrically held on the adjustment screw 41. In this way, the adjustment screw 41 can be turned out from or turned in the tube 39 and locked in place with the lock ring 43, like a jamb nut, to fix an end 45 of the adjustment screw 41 which engages and supports an end of a skewer 47 (FIG. 1) that extends through and supports a hub 49 (FIG. 1) of the driven wheel 11.

Still referring to FIGS. 1 and 2, the locking device 37 of the wheel support system 33 includes a tube 51 that has a circumferential side wall 53 and a slot 55 that extends through the circumferential side wall 53 along a generally helical path. A pocket (not shown) extends from an inward end of the slot 55 that is closest to the driven wheel 11 and provides a recess in which a handle 59 that extends through the slot 55 can lock into to secure the handle 59 in a fixed position, in a bolt-action manner. The handle 59 is connected to a bolt tube 61 that is arranged concentrically within the circumferential side wall 53 so that the bolt tube 61 slides through a longitudinally extending opening of the tube 51. The handle 59 and bolt tube 61 move in unison with each other so that moving the handle through the slot 55 toward the driven wheel 11 correspondingly moves the bolt tube 61 in the same direction so that it extends further beyond the tube 51, toward the driven wheel. This allows for mounting the driven wheel 11 in a known manner by arranging the skewer 47 (FIG. 1) between the adjustment screw 41 and bolt tube 61 and advancing the handle 59 through the slot 55 until it enters and is held in the pocket (not shown) at the inward end of the slot 55, at which point the skewer 47 (FIG. 1) is pinched between the adjustment screw 41 and the bolt tube 61 and the driven wheel 11 is in driving engagement with the resistance unit 13. Again, it is understood that any other satisfactory arrangement may be employed for securing the bicycle wheel in place on the frame 9.

Figure 3:
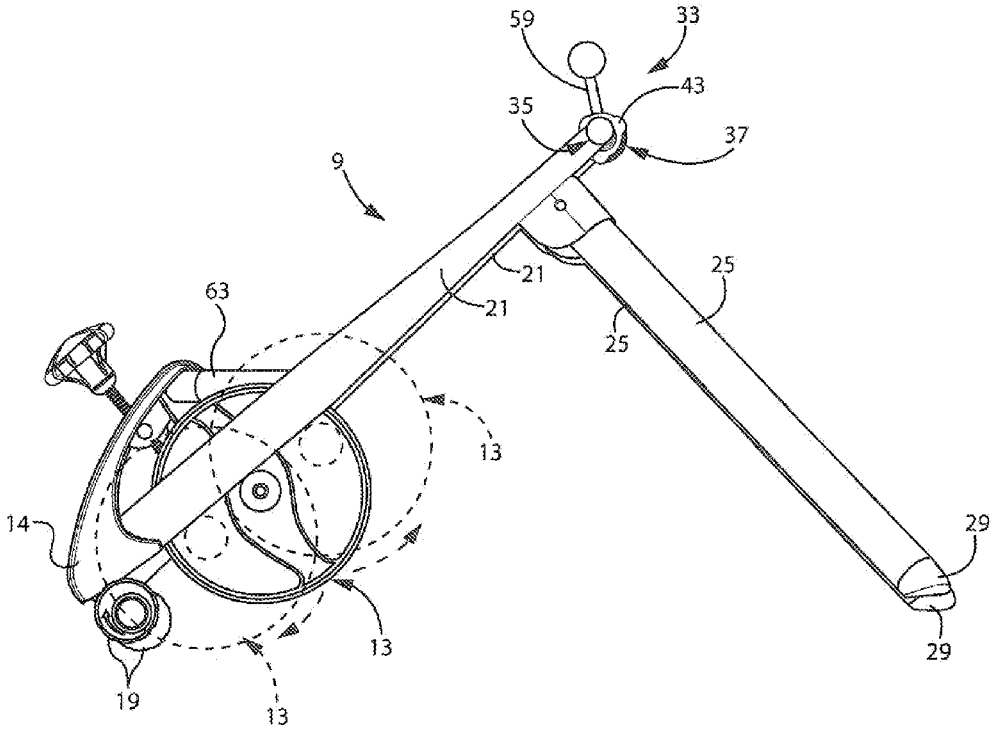
FIG. 3 is a side elevation view of the bicycle trainer with reverse resistance unit mounting arrangement as shown in from FIGS. 1 and 2.

Still referring to FIGS. 1 and 2, the resistance unit 13 is supported by a supporting member secured to the frame 9, which may be in the form of a hoop 63 that is generally U-shaped and is arranged generally parallel to the ground or other underlying support surface. Hoop 63 extends between and connects the frame side segments 21 to each other. The resistance unit 13 is supported by the hoop 63 in a manner that allows the resistance unit to move in a tightening direction toward and in a loosening direction away from the driven wheel 11. Referring now to FIG. 3, the resistance unit 13 is movable with respect to the frame 9 between a fully extended position, shown in phantom-dashed outline closer to the legs 25 and a fully retracted potion, shown in phantom-dashed outline further from the legs 25.

Figure 4:
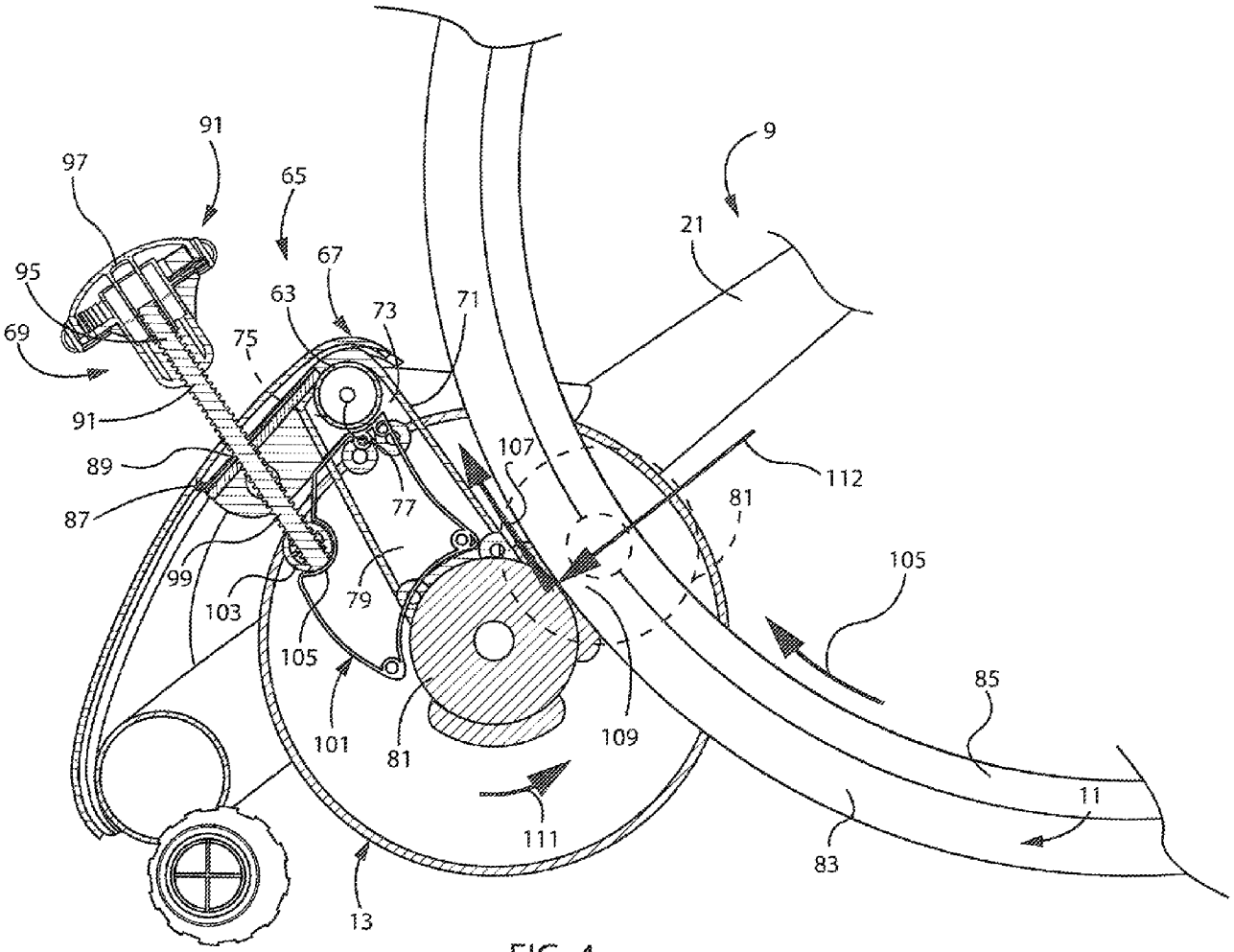
FIG. 4 is a section view taken along line 4-4 of FIG. 2.

Referring now to FIG. 4, a hinge arrangement 65 interconnects the resistance unit 13 and the hoop 63. The hinge arrangement 65 includes a hinge 67 and an adjuster 69 that cooperate with each other to locate the resistance unit 13 in a generally longitudinal direction within the bicycle trainer 5 (FIG. 3). Hinge 67 includes a hinge arm 71 with an upper end 73 that has an opening 75 that concentrically holds the hoop 63 and is arranged so that the hinge arm 71 can pivot about the hoop 63. In this way, a pivot axis 77 of the hinge 67 is defined longitudinally through the hoop 63. A lower end 79 of the hinge arm 71 supports the resistance unit 13 so that a roller 81 of the resistance unit 13 can freely rotate as driven by its engagement with tire 83 that is mounted to a rim 85 of the driven wheel 11.

Still referring to FIG. 4, the adjuster 69 includes a plate 87 that extends generally parallel to the side segment(s) 21 and has a threaded bore 89 through which threaded stem 91 of a handle 93 extends. The threaded stem 91 of the handle 93 extends generally parallel to the hinge arm 71 and has a first end 95 to which a knob 97 is connected and a second end 99 that can rotate in unison with a block 101 that is connected to and moves the resistance unit 13. As shown in FIG. 4, this is done with a cylinder 103 that is captured in a pocket 105 of the block 101 while being rotatable within the pocket 105. In this way, the adjuster 69 can be used to set the initial tightness of the resistance unit 13 by rotating the knob 97 in a first direction so that the threaded stem 91 advances through the plate 87 and the ball 103 moves longitudinally away from the plate 87 and pushes the block 101, which forces the entire resistance unit 13 to pivot about the pivot axis 77 of the hinge 67 so as to move the roller 81 closer to the driven wheel 11. The knob 97 is rotated in a second, opposite direction to move the resistance unit 13 in the opposite direction, away from the driven wheel 11 so as to loosen the resistance unit 13.

Still referring to FIG. 4, the hinge arrangement 65 allows the resistance unit 13 to automatically bias in its tightening direction when a driving torque of the driven wheel 11 is applied or increased so as to dynamically increase traction of the driven wheel 11 against the roller 81. That is, because the driven wheel 11 rotates in its use direction shown as arrow 105, the driven wheel 11 applies a rotational force to the roller 81 that extends in a direction of a tangent line shown as arrow 107 from a contact area 109 defined at the interface of the roller 81 and tire 83. Since the pivot axis 77 is positioned above and behind the contact area 109, the vector of the rotational force tangent line 107 causes the force to push the hinge arm 71 to pivot about the pivot axis 77 in the tightening direction of the resistance unit 13 toward the wheel 11 in an automatic dynamic biasing movement represented by arrow 111. This increases the normal force 112 at the interface of the roller 81 and tire 83 so as to further tighten an engagement between the roller 81 and tire 83 at the contact area 109. In this way, as a user pedals faster or otherwise increases driving speed of the driven wheel 11, the reactionary forces experienced by the resistance unit 13 bias the resistance unit 13 toward driven wheel 11 so as to increase traction through an increase in the normal force 112 at the interface of the roller 81 and tire 83 and thus at the contact area 109. In this manner, it is insured that there is no slippage between wheel 11 and resistance unit 13, which provides a more realistic ride feel during use of trainer 5.

While a specific embodiment of the tightening and adjustment arrangement are shown for illustrative purposes, it is understood that any other satisfactory mechanism may be employed for selectively moving resistance unit 13 toward and away from the bicycle wheel 11.

Various alternatives and embodiments are contemplated as being within the scope of the following claims particularly pointing out and distinctly claiming the subject matter regarded as the invention.

We claim:

1. A bicycle trainer, comprising:

a frame that can support a bicycle in a generally stationary position while a user exerts a pedaling effort to rotate a driven wheel of the bicycle during a training session; and a resistance unit that is supported by the frame and that cooperates with the driven wheel of the bicycle so as to resist the pedaling effort of the user, the resistance unit being movable in a tightening direction in which the resistance unit moves toward the driven wheel and in a loosening direction in which the resistance unit moves away from the driven wheel, the resistance unit arranged with respect to the frame so that when a torque that rotates the driven wheel is applied, a normal force between the resistance unit and the driven wheel is increased.

2. The bicycle trainer of claim 1, wherein the resistance unit includes a roller that engages a tire that is mounted to the driven wheel at a contact location and wherein the resistance unit is supported from the frame at a support location that is arranged at a greater height upon the frame than the contact location.

3. The bicycle trainer of claim 2, wherein a hinge for supporting the resistance unit is arranged between the frame and the resistance unit and the support location is defined at a pivot axis of the hinge.

4. The bicycle trainer of claim 3, wherein the tightening direction of movement of the resistance unit is defined by a pivot path that advances toward the driven wheel so that a rotational force of the driven wheel can relatively further tighten an engagement between the driven wheel and the resistance unit that corresponds to the increase in the normal force.

5. The bicycle trainer of claim 3, wherein the hinge includes a hinge barrel and a hinge arm that extends downwardly from the hinge barrel and wherein the resistance unit is interconnected to an end of the hinge arm.

6. The bicycle trainer of claim 4, further comprising an adjuster for moving the resistance unit in the tightening and loosening directions.

7. The bicycle trainer of claim 6, wherein the resistance unit can automatically bias in a tightening direction to increase traction of the tire.

8. A method of using a bicycle trainer, comprising:

supporting a bicycle in a frame of a bicycle trainer so that the bicycle is maintained in a generally stationary position while a user exerts a pedaling effort to rotate a driven wheel of the bicycle during a training session;

rotating a roller of a resistance unit that is supported by the frame by an engagement of a tire mounted to the driven wheel and the roller of the resistance unit; and increasing traction of the tire mounted to the driven wheel by automatically increasing the normal force between the resistance unit roller and the driven wheel upon an increase in speed of the driven wheel.

9. The method of using a bicycle trainer of claim 8, wherein a hinge connects the resistance unit and the frame.

10. The method of using a bicycle trainer of claim 9, wherein the resistance unit includes a roller that contacts the tire of the bicycle.

11. The method of using a bicycle trainer of claim 10, wherein the hinge is located above and behind the location of contact between the tire and the resistance unit, such that the hinge will allow the resistance unit to pivot towards the tire in an automatic dynamic biasing movement.

12. The method of using a bicycle trainer of claim 11, wherein the resistance unit has an adjuster that can set an initial resistance applied to the bicycle tire by the resistance unit, and that can move the resistance unit towards the tire in a tightening direction and in a loosening direction to move the resistance unit away from the tire.

13. The method of using a bicycle trainer of claim 12, wherein the hinge and the adjuster allow the resistance unit to move in a generally longitudinal direction toward and away from the bicycle tire.

14. A resistance arrangement for use with a stationary bicycle, comprising:

a resistance unit;

a resistance unit support structure that is arranged above a surface; and a pivot connection that connects the resistance unit and the support structure, wherein the resistance unit is supported from the pivot connection and the support structure in a suspension-type manner;

wherein, when the resistance unit is engaged with a wheel of the stationary bicycle, the resistance unit moves in a tightening direction toward the bicycle wheel upon rotation of the bicycle wheel.

15. The resistance unit of claim 14, further comprising for an actuator arrangement interconnected between the resistance unit and the support structure for selectively moving the resistance unit toward and away from the bicycle wheel.

* * * * *